US006453837B1

(12) United States Patent
Arbaugh et al.

(10) Patent No.: US 6,453,837 B1
(45) **Date of Patent: *Sep. 24, 2002**

(54) WATERCRAFT BEACHING DEVICE

(75) Inventors: Gary L. Arbaugh; John R. Land; Keith B. Moreland, all of Boise, ID (US)

(73) Assignee: Ski 52, LLC, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/565,194

(22) Filed: May 4, 2000

Related U.S. Application Data

(63) Continuation-in-part of application No. 09/369,029, filed on Aug. 4, 1999, which is a continuation-in-part of application No. 09/191,155, filed on Nov. 12, 1998, now abandoned.

(51) Int. Cl.[7] ..... B63B 59/02
(52) U.S. Cl. ..... 114/219; 405/1
(58) Field of Search ..... 405/1–7; 114/219, 114/221 R, 343, 361

(56) References Cited

U.S. PATENT DOCUMENTS

| | | | | | |
|---|---|---|---|---|---|
| 3,055,022 | A | | 9/1962 | Vallquist | 114/343 |
| 3,353,363 | A | | 11/1967 | Edson | 405/1 |
| 3,579,996 | A | * | 5/1971 | Edson | 405/1 |
| 4,762,080 | A | | 8/1988 | Pearson | 114/219 |
| 4,803,942 | A | | 2/1989 | Dren et al. | 114/219 |
| 4,815,412 | A | | 3/1989 | Cassaro, Jr. | 114/343 |
| 4,909,172 | A | | 3/1990 | Hamby | 114/219 |
| 4,962,719 | A | | 10/1990 | Hughes et al. | 114/343 |
| 4,972,791 | A | | 11/1990 | Williams | 114/219 |
| 5,267,811 | A | | 12/1993 | Evans | 405/1 |
| 5,357,890 | A | | 10/1994 | Mason, Jr. et al. | 114/219 |
| 5,398,631 | A | | 3/1995 | Miller | 114/219 |
| 5,454,341 | A | | 10/1995 | Bensley et al. | 114/343 |
| 5,477,802 | A | | 12/1995 | Laue | 405/1 |
| 5,577,455 | A | | 11/1996 | Dvorak | 114/219 |

* cited by examiner

*Primary Examiner*—Ed Swinehart
(74) *Attorney, Agent, or Firm*—Joseph W. Holland

(57) ABSTRACT

A watercraft beaching device 10 includes one or more collapsible upright supports 11 and 12 which hold a pair cushioned hull engagement surfaces 13 in spaced apart relationship. Advantageously, hull engagement surfaces 13 are elongated to engage more than a single point or area along on side of the hull of watercraft 1 to prevent watercraft 1 from pivoting about the mooring point on the shoreline. Additionally, supports 11 and 12 are configured to hold hull engagement surfaces 13 a sufficient distance above the shoreline to insure that the hull does not come into contact with the aforementioned abrasive agents or shoreline.

4 Claims, 21 Drawing Sheets

WATERCRAFT BEACHING DEVICE

RELATED APPLICATIONS

This application is a continuation-in-part of application Ser. No. 09/369,029, entitled WATERCRAFT BEACHNG DEVICE and filed on Aug. 4, 1999, which is a continuation-in-part of application Ser. No. 09/191,155 entitled WATERCRAFT BEACHNG DEVICE and filed on Nov. 12, 1998 now abandoned.

BACKGROUND OF THE INVENTION

1. Technical Field

This invention generally relates to personal watercraft and boat protection devices, hereinafter simply watercraft protection devices. More particularly, this invention relates to a watercraft protection device for protecting the hull or keel of the watercraft during beaching.

2. Background

Increased popularity of recreational boating has resulted in increased competition for landing space. Most developed inland lakes and bays include public boat docks or piers extending from their shores and beaches, which can be used by recreational boaters when they want to go ashore. However, competition for these resources has resulted in limited availability. Oftentimes, a desirable beach or shore doesn't have any landing facilities. Additionally, there are a large number of undeveloped lakes that simply do not have any public docks.

Consequently, larger numbers of boaters are resorting to beaching their boats to gain shore access, resulting in abrasion to the hulls of the boats. Most recreational motor and sail boats have hulls of fiberglass construction with a gel coat finish. These hulls are extremely susceptible to damage from beaching and beach mooring. The sand, sediment and rocks typically found on a beach or shoreline act as abrasion agents, especially as wave and wind action move the boat up, down, forward and backward. Additionally, when a boat is beached, it has a tendency to pivot about the contact point with the beach or shore due to wave and wind action on the stern of the boat. In addition to the damage caused to the hull of the boat, this can result in the drive and steering mechanisms coming into contact with the bottom of the body of water or in dislodging the boat from the shore.

Several attempts have been made to remedy these problems, including apron protection type devices, beach mats, strip hull protectors and ramp type devices.

U.S. Pat. Nos. 3,055,022; 4,815,412; 4,962,719; and 5,357,890 disclose apron-type hull protectors which are attached to the bow of the boat and positioned under the front hull portion to protect the hull from damage when beaching a boat. These patents disclose different flotation, drag and weights, as well as construction methods for positioning the aprons and providing protection.

U.S. Pat. Nos. 4,803,942; 5,398,631; 5,454,341; and 5,577,455 all teach various landing or beach mats for protecting the front portion of the hull of a boat during beaching. U.S. Pat. No. 4,803,942 includes a pair of elongated support blocks along the length of the mat.

U.S. Pat. Nos. 4,762,080 and 4,909,172 disclose protective bow strips which are fixed along the keel, at the front portion of the hull, to protect the boat hull during beaching.

U.S. Pat. No. 4,972,791 discloses a collapsible boat device for protecting the underside of a beached boat. This device includes a pair of hinged plates each supported by a plurality of wedges to hold the plates in a "V" formation to receive the hull of a boat. The device also includes one or more attachment devices, such as ropes, to attach the protection device to the boat to facilitate positioning of the protection device prior to beaching. When not in use, the two plates fold together to permit more compact storage of the device, preferably into a folded size of one foot wide by three feet long by ten inches high. Unfortunately, even the folded size is too large for convenient storage within a boat and the preferred construction results in a device that is too heavy to be handled efficiently. Additionally, the plates present a relatively large surface area to contact the hull of the boat and due to the configuration of the device, sand and the like can easily become lodged between the plates and the hull, resulting in damage to the boat.

None of the solutions of which the inventors are aware adequately solve the problems mentioned. To date, the solutions are ineffective at adequately inhibiting abrasion, securely mooring the boat and/or are suitable for compact storage and easy handling.

SUMMARY OF THE INVENTION

The present invention solves the forgoing problems by providing a collapsible watercraft beaching device which includes one or more collapsible upright supports which hold a pair cushioned hull engagement surfaces in spaced apart relationship. Advantageously, the hull engagement surfaces are elongated to engage more than a single point or area along on side of the boats hull to prevent the watercraft from pivoting about the mooring point on the shoreline and yet still require only a minimum of surface contact with the hull of the watercraft. Additionally, the supports are configured to hold the hull engagement surfaces a sufficient distance above the shoreline to insure that the hull of the watercraft does not come into contact with the aforementioned abrasive agents or shoreline.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
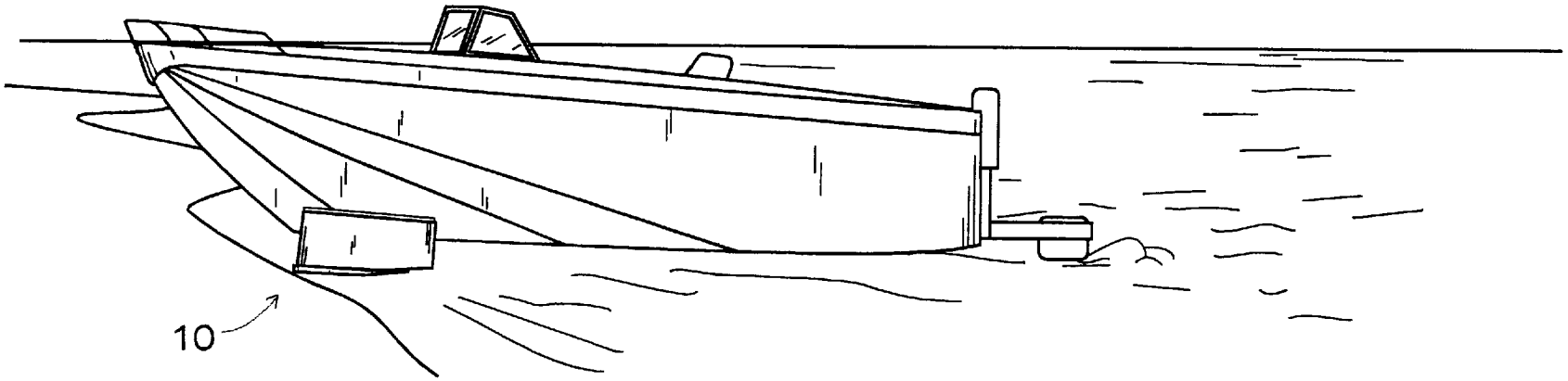
FIG. 1 is a perspective view of a watercraft beaching device according to the invention.

Referring now to the figures, a few of several possible embodiments of a watercraft beaching device, generally designated as 10, are illustrated in detail. In general terms, watercraft beaching device 10 includes one or more collapsible upright supports 11 and 12 which hold a pair cushioned hull engagement surfaces 13 in spaced apart relationship. Advantageously, hull engagement surfaces 13 are elongated to engage more than a single point or area along on side of the hull of watercraft 1 to prevent watercraft 1 from pivoting about the mooring point at or near the shoreline. Additionally, supports 11 and 12 are configured to hold hull engagement surfaces 13 a sufficient distance above the bottom of the body of water to insure that the hull does not come into contact with the aforementioned abrasive agents or shoreline.

FIGS. 1 through 6 illustrate one possible embodiment which includes a base 14 to which collapsible upright supports 11 and 12 are hinged via base hinges 18. Each of the upright supports here includes a hinge leg 15 and a free leg 16 which are hinged together via leg hinge 17. Hinge leg 15 is attached to base 14 by base hinge 18 and base clearance block 19. Base clearance block 19 elevates the hinge attachment point above the upper surface of the main base a distance equal to, or greater than the folded thickness of legs 15 and 16 to allow the legs to be folded flat against base 14. A support lock 20 acts to secure upright supports 11 and 12 in their respective upright positions. Here, support lock 20 is one or more lip members secured at various points along the marginal edges of the upper surface of base 14 and positioned to interfere with outward movement of the distal edges of free legs 16.

Alternatively or in addition to the lip members, extension limiting straps 21 can be used. Here, extension limiting straps 21 are connected between the distal edge of free leg 16 and the proximal edge of hinge leg 15. In the case where only an extension limiting device is used, such as extension limiting straps 21, it is important that base 14 extend outward far enough to engage and support the distal edges of free legs 16. This feature prevents the center of device 10 from raising, which can cause the center of the device to contact the hull and can increase the separation distance between hull engagement cushions 13. One or more grab straps or handles 22 can be attached to various points of the device to facilitate setup and take-down, as well as carrying the device.

Figure 2:
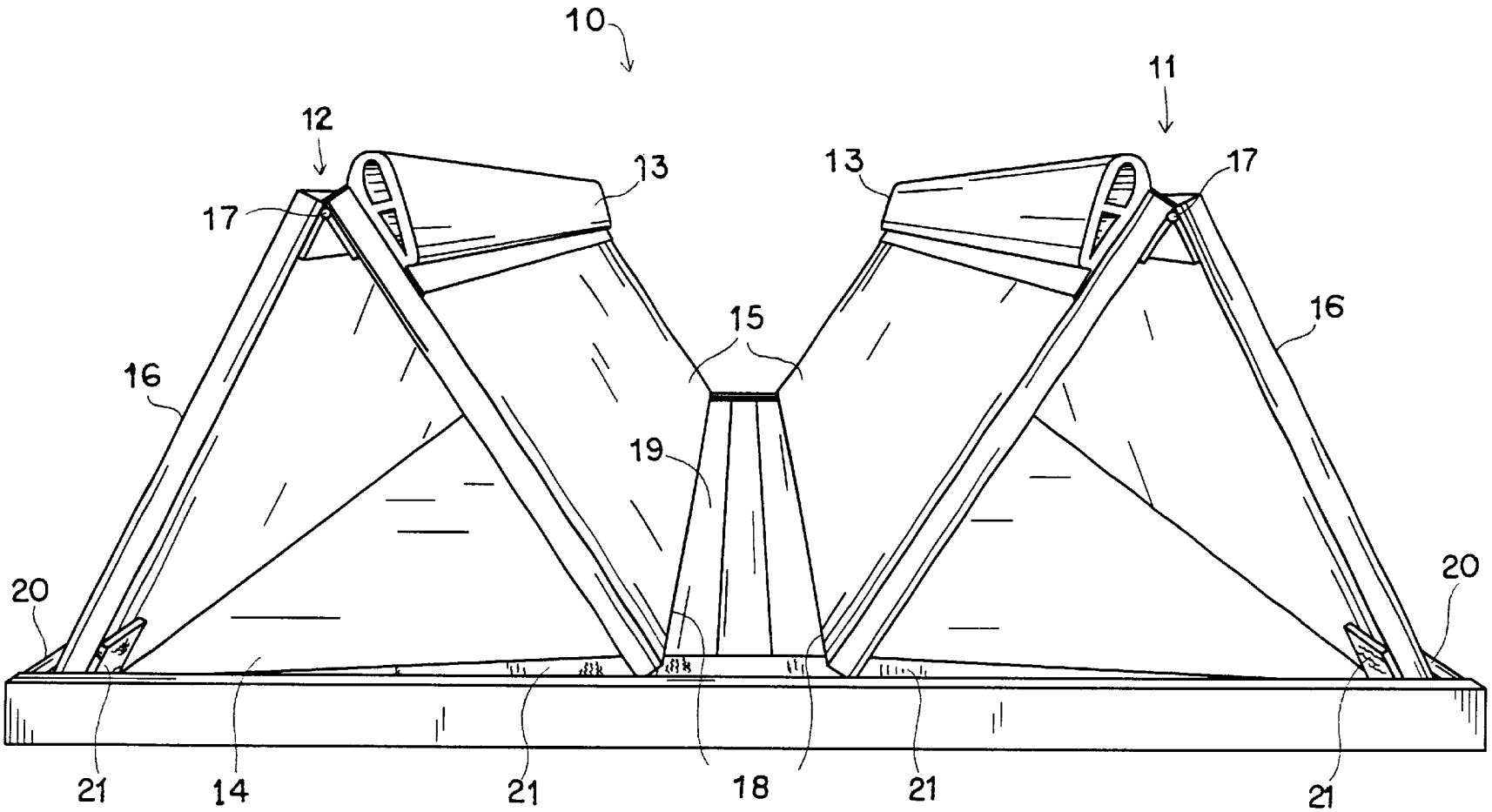
FIG. 2 is a front perspective view of a one possible embodiment of the invention.
Figure 3:
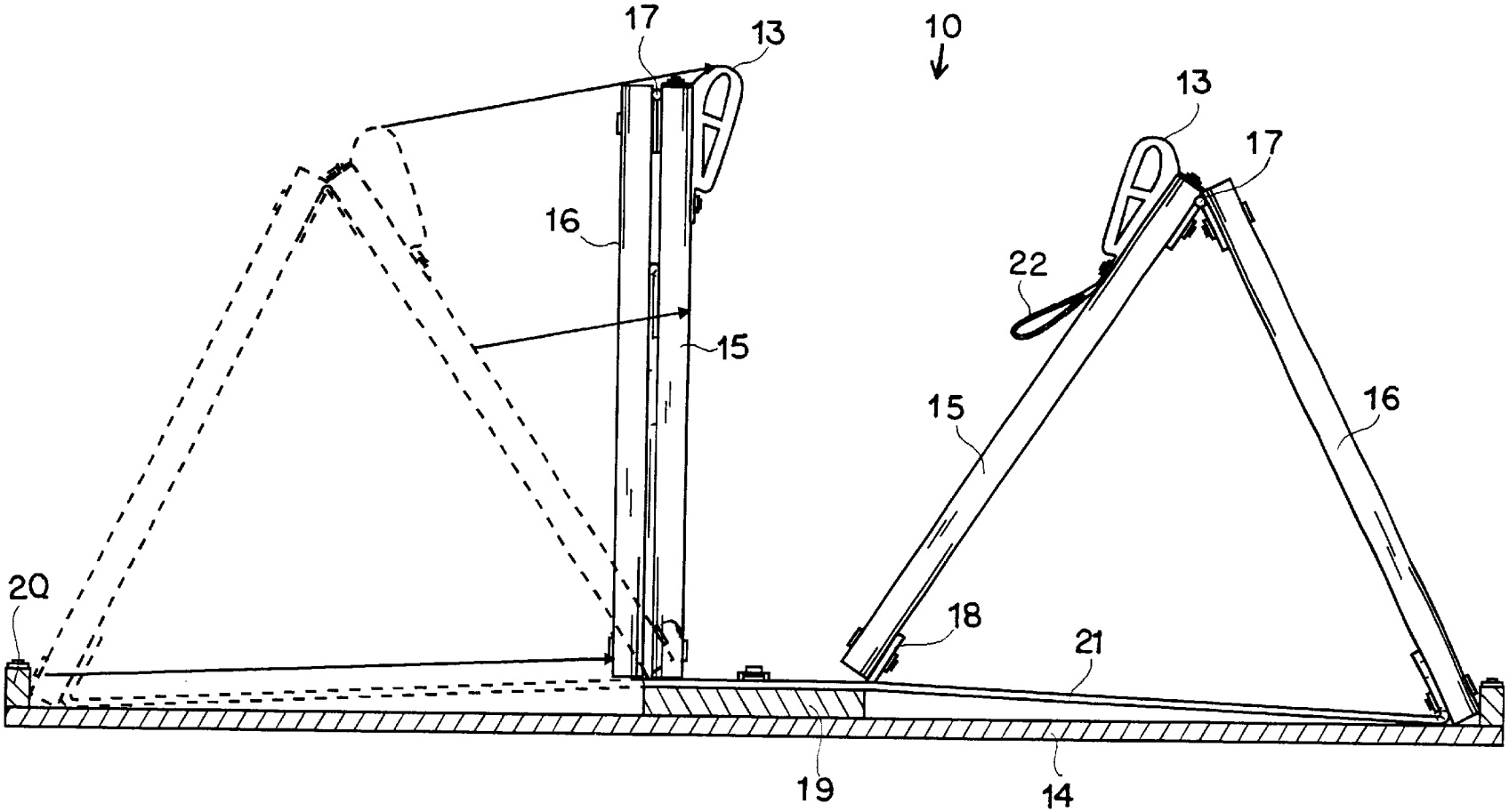
FIG. 3 is a partially cut away front view of the embodiment of FIG. 2 in a partially folded state.
Figure 4:
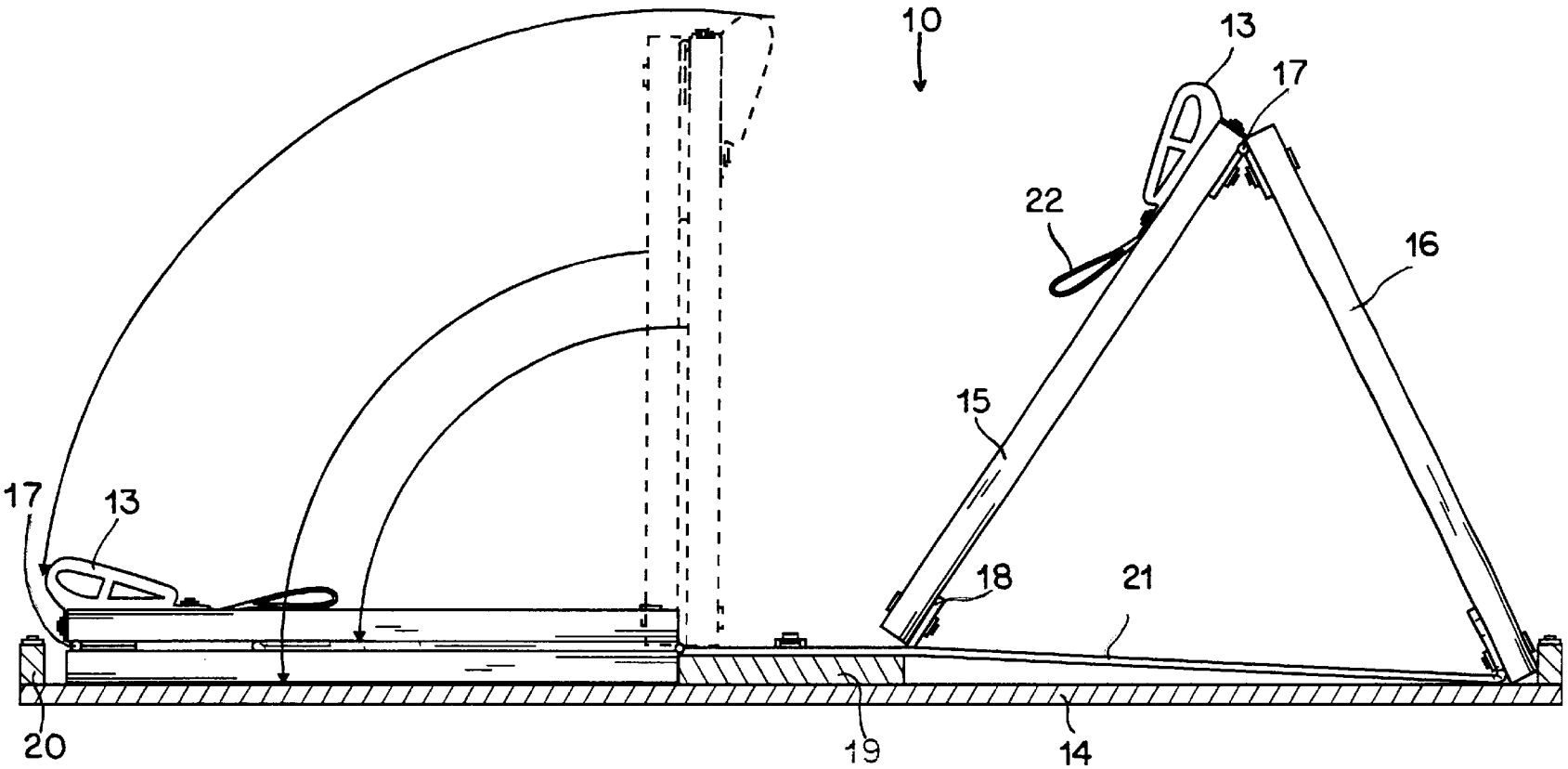
FIG. 4 is a partially cut away front view of the embodiment of FIG. 2 in a partially folded state.
Figure 5:
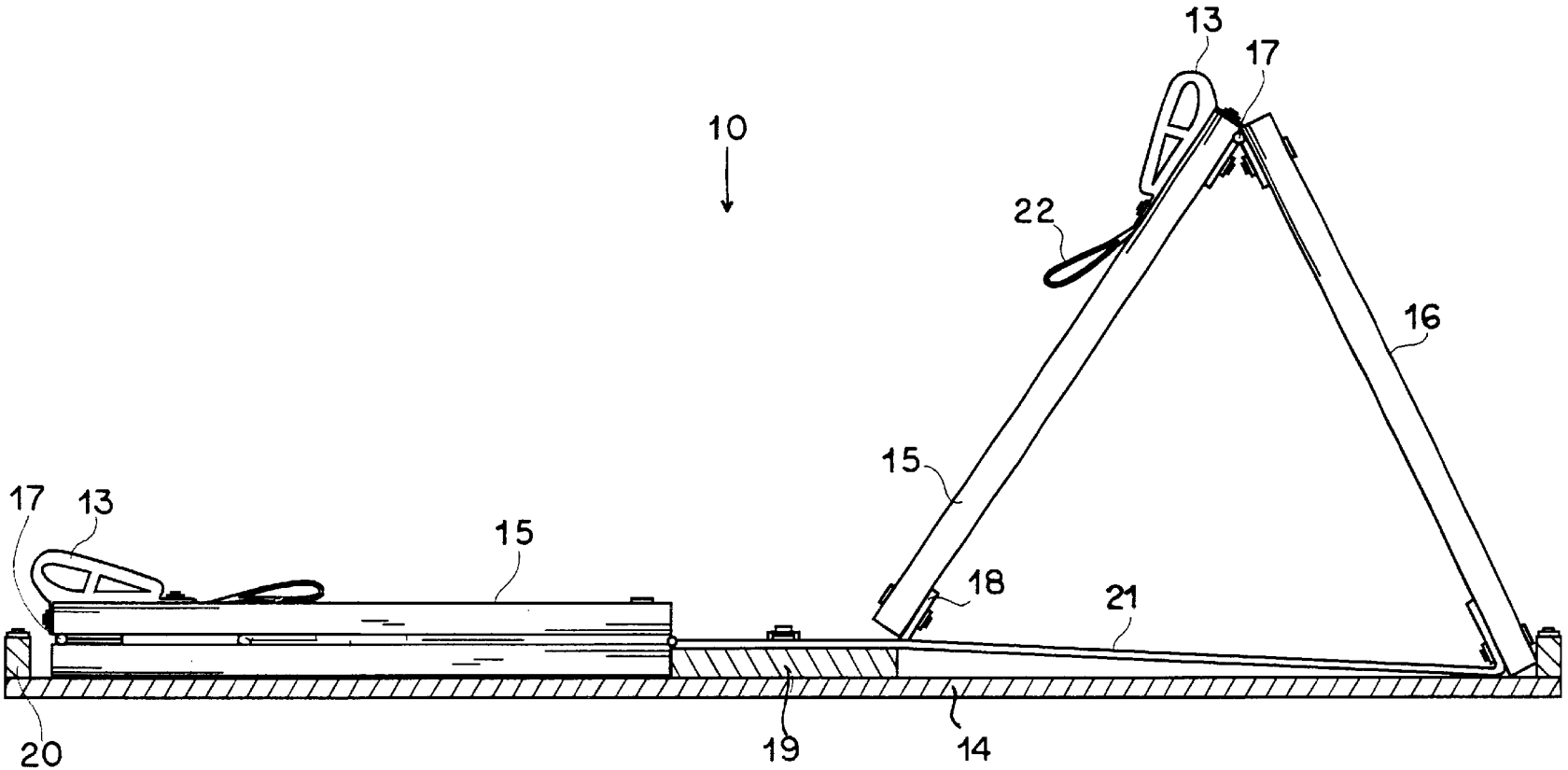
FIG. 5 is a partially cut away front view of the embodiment of FIG. 2 in a partially folded state.
Figure 6:
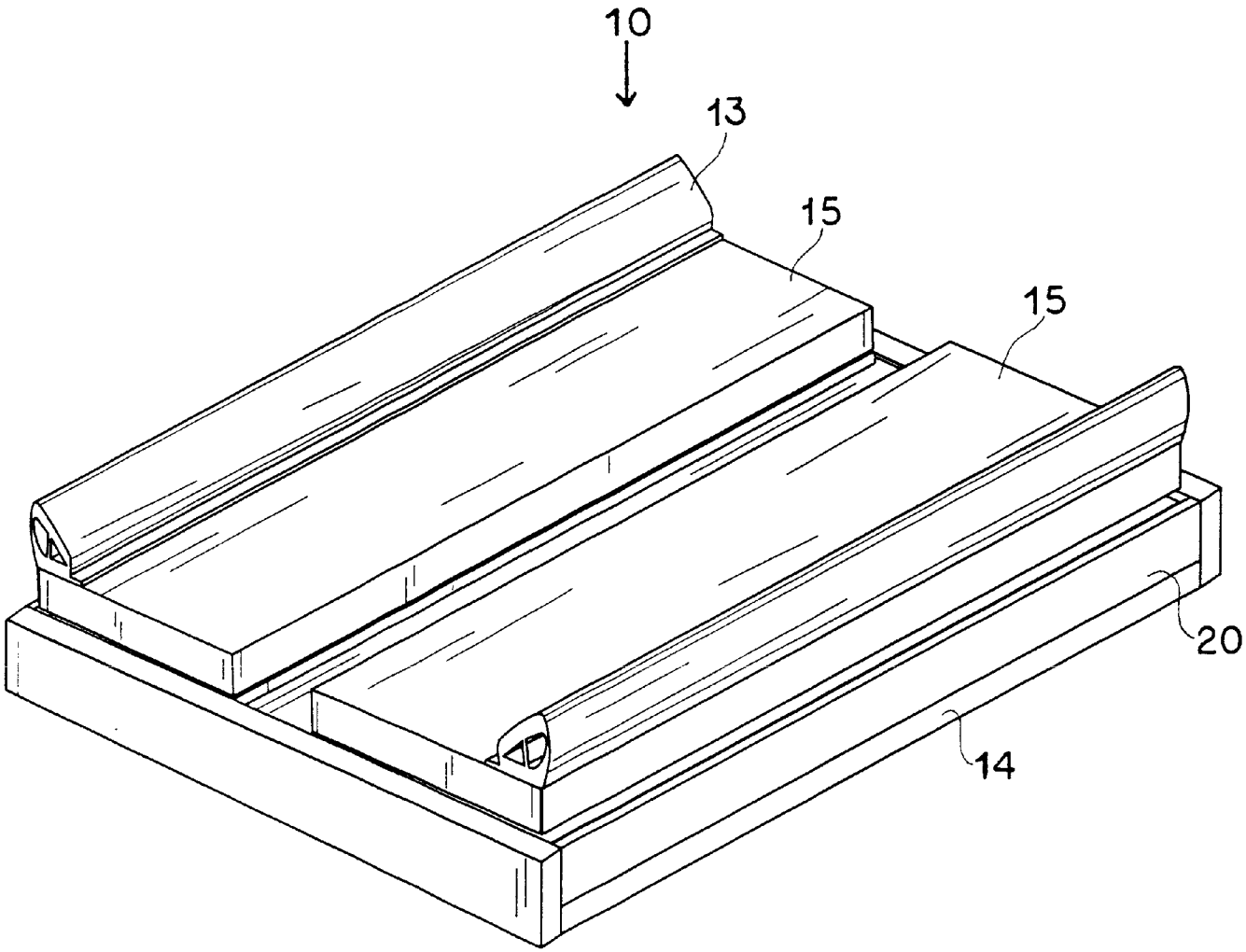
FIG. 6 is a front perspective view of the embodiment of FIG. 2 in a completely folded state

FIG. 2 shows watercraft beaching device 10 in it's fully setup position. To collapse the device, the distal edge of free leg 16 is folded inward about hinge 17 and at the same time, hinge leg 15 is pivoted about hinge 18 toward a more vertical position as is shown in FIG. 3. The folded support assembly is then folded down, about hinge 18 into the position shown in FIGS. 4 and 5. The other support assembly is collapsed the same way to form the collapsed or folded configuration shown in FIG. 6. The device is setup by reversing this procedure.

Figure 7:
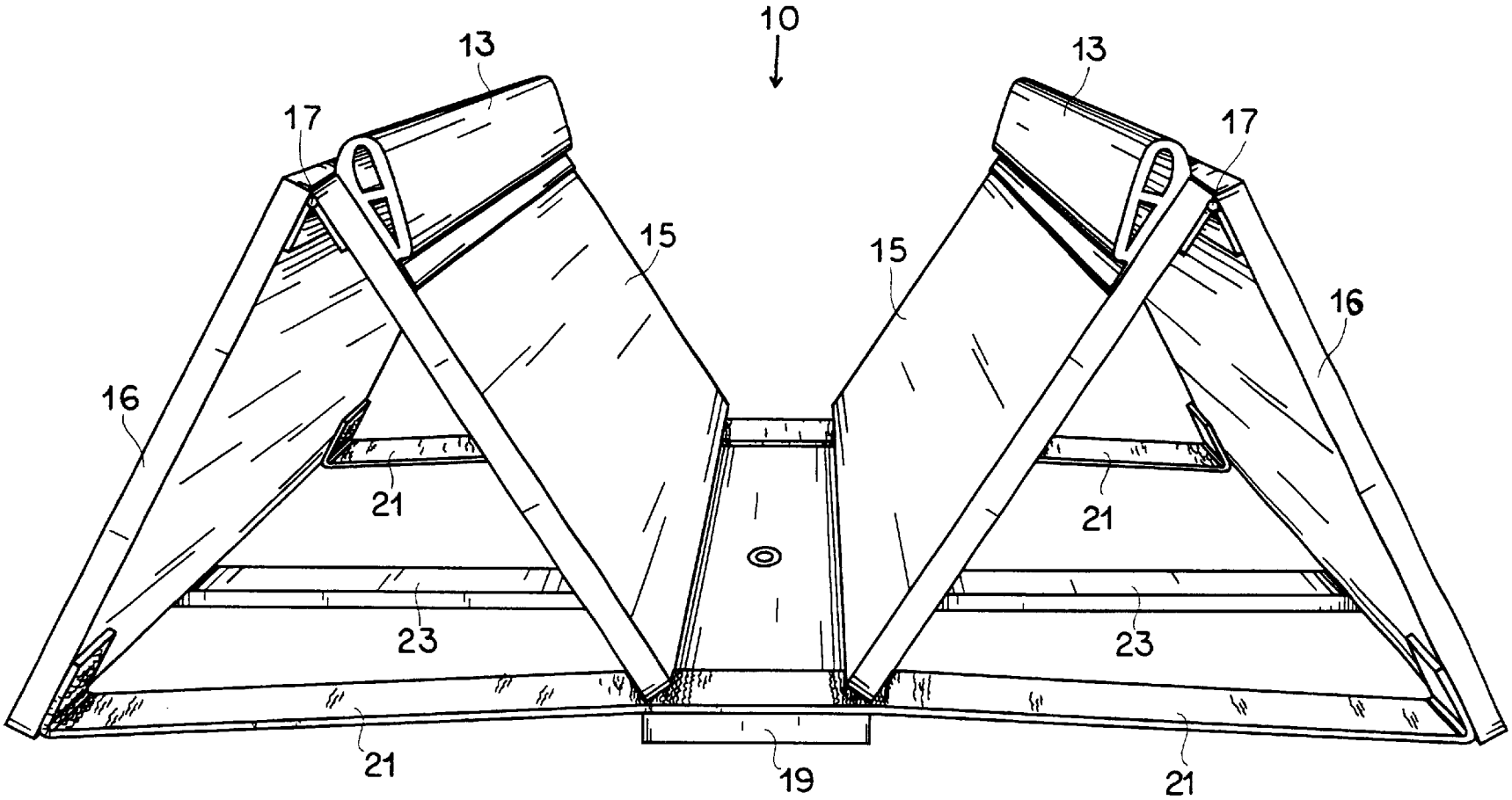
FIG. 7 is a front perspective view of another possible embodiment of the invention.
Figure 8:
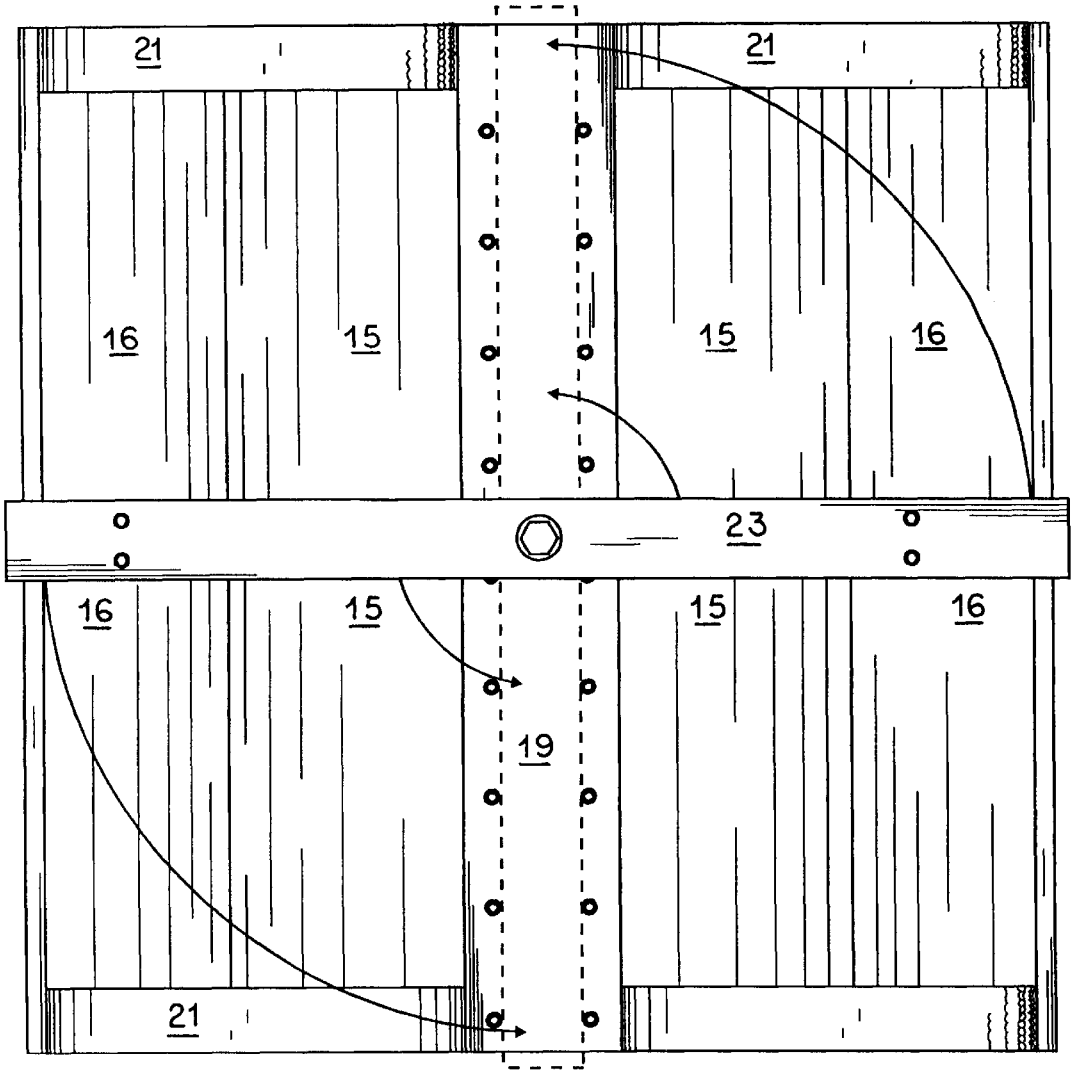
FIG. 8 is a bottom view of the embodiment of FIG. 7.
Figure 9:
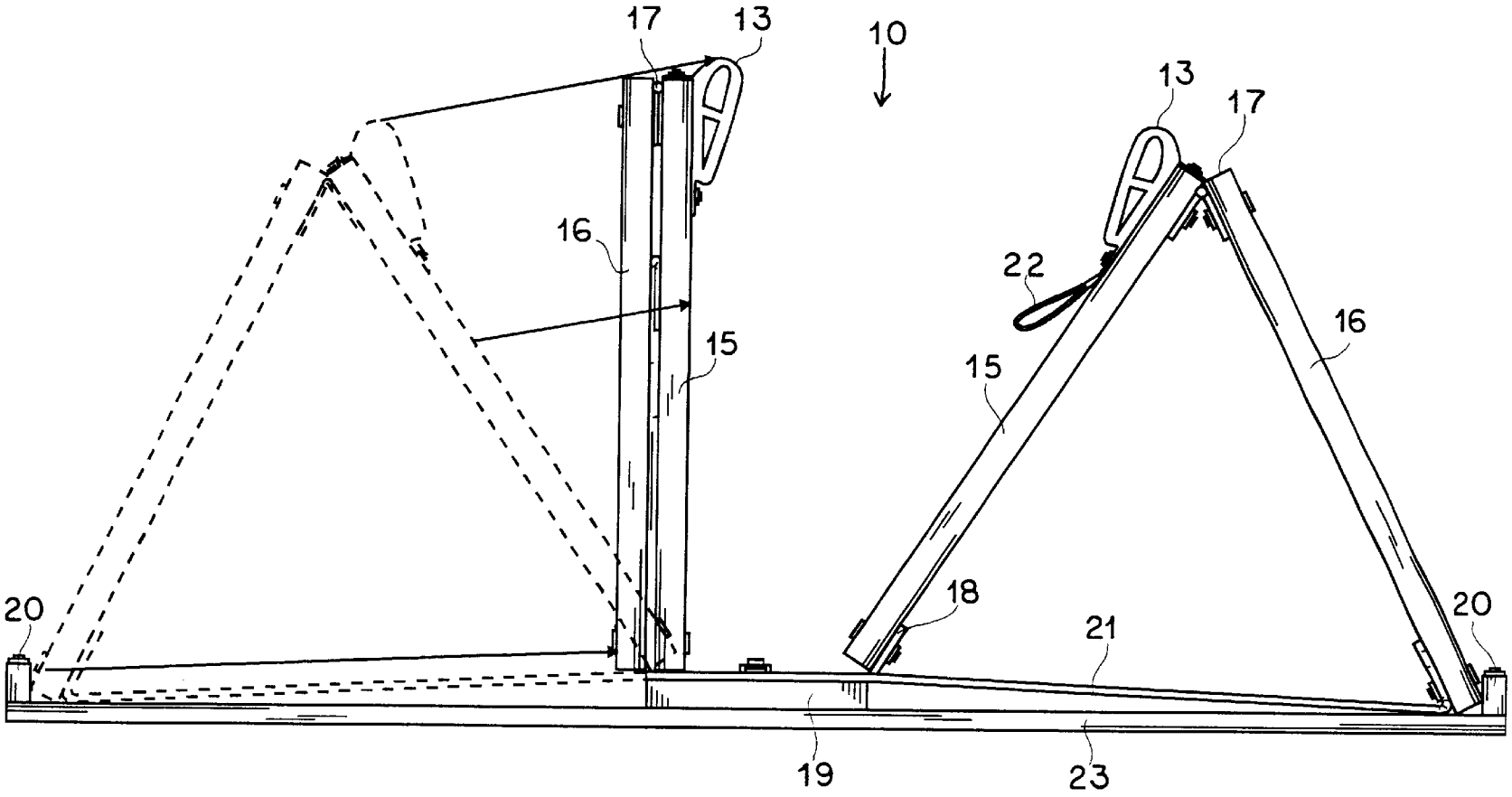
FIG. 9 is a partially cut away front view of the embodiment of FIG. 7 in a partially folded state.
Figure 10:
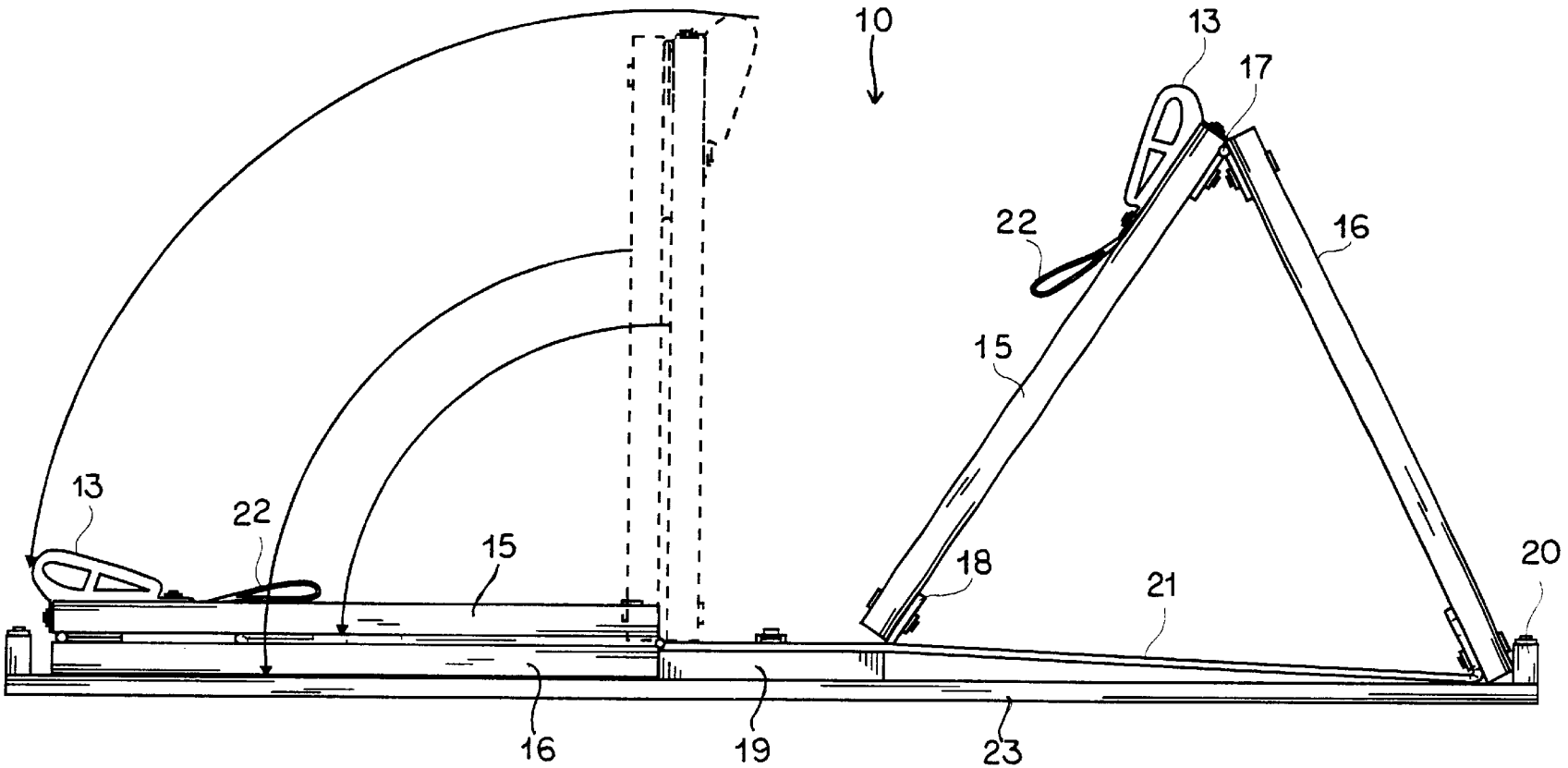
FIG. 10 is a partially cut away front view of the embodiment of FIG. 7 in a partially folded state.
Figure 11:
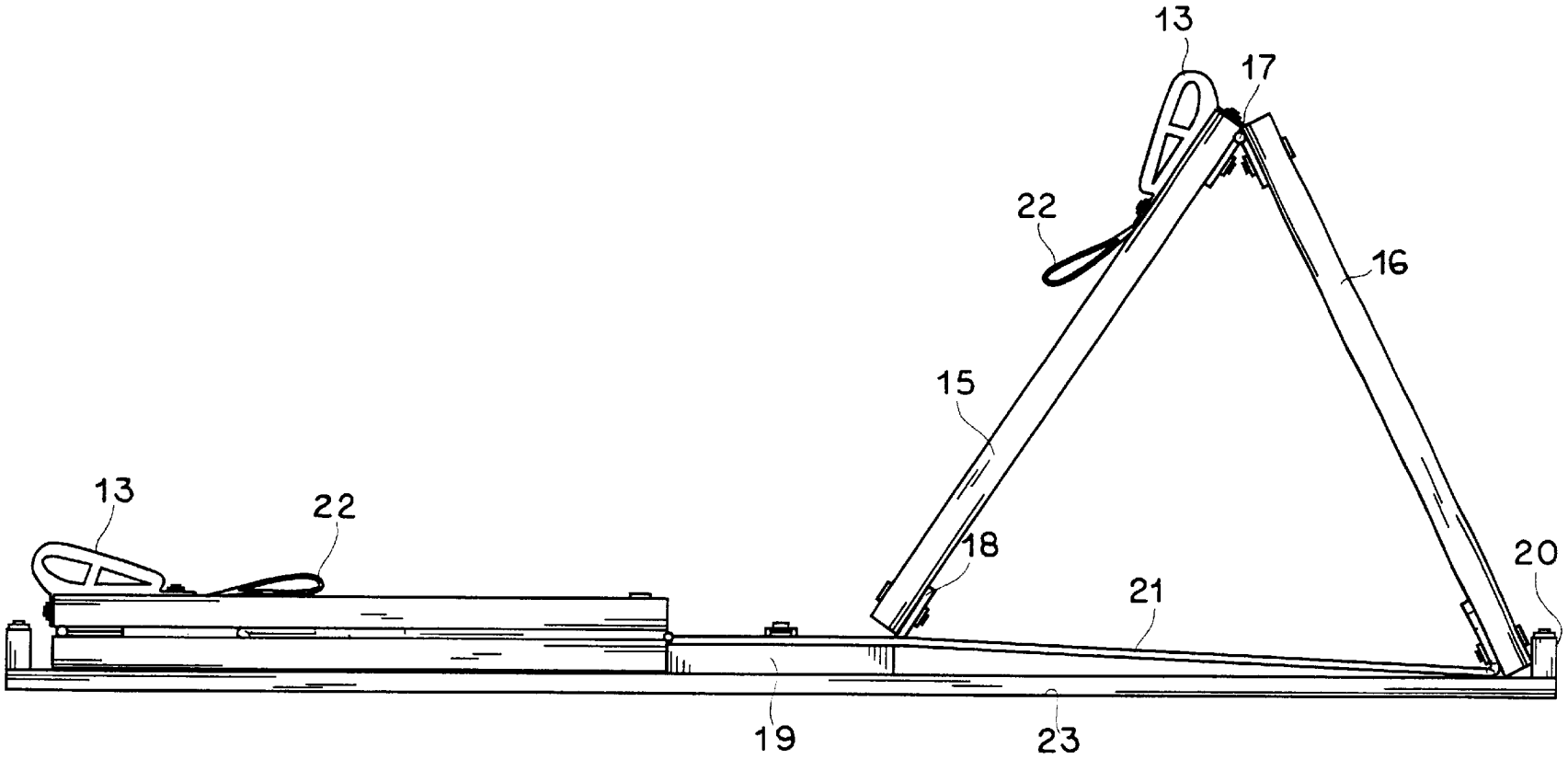
FIG. 11 is a partially cut away front view of the embodiment of FIG. 7 in a partially folded state.
Figure 12:
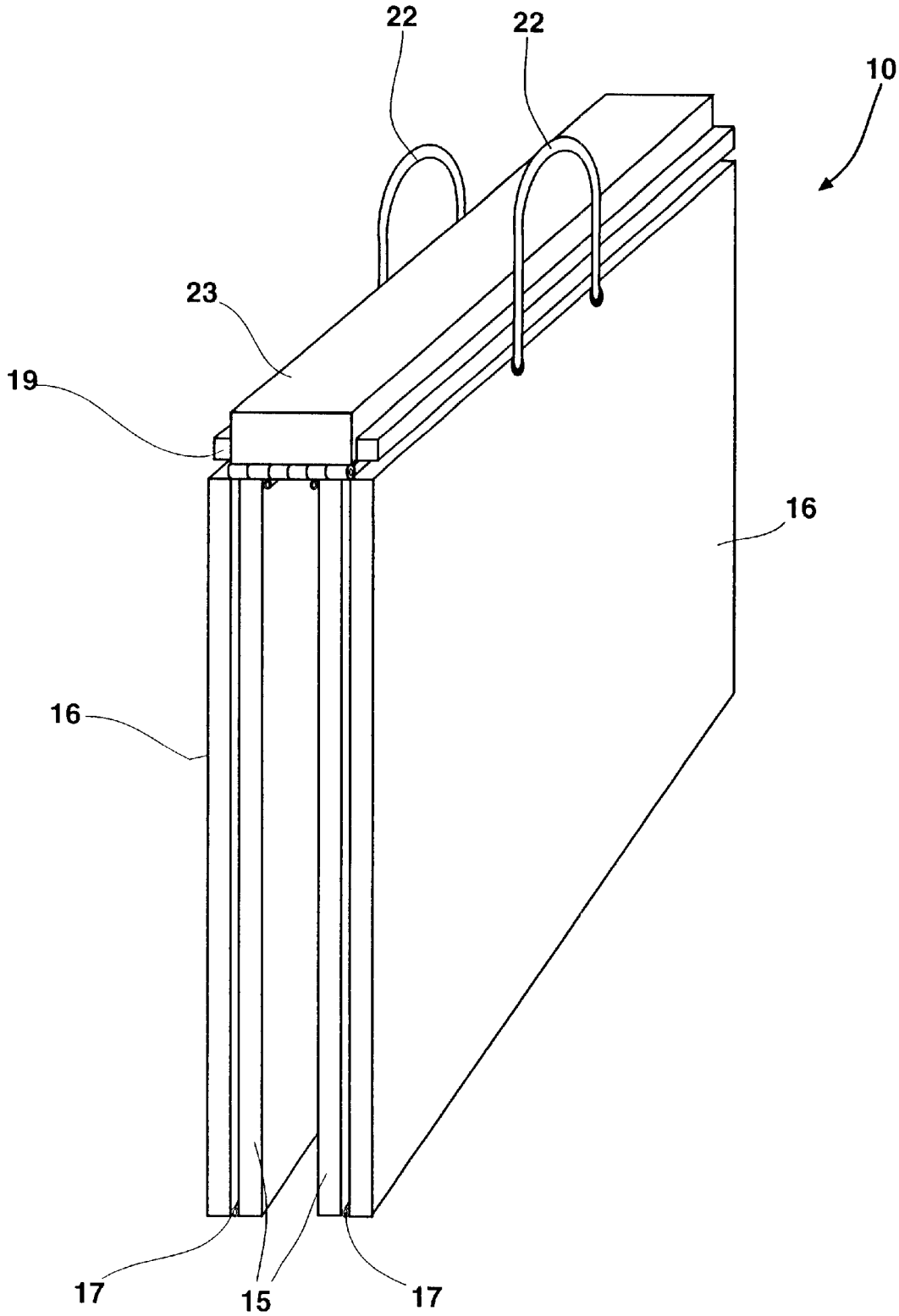
FIG. 12 is a front perspective view of the embodiment of FIG. 7 in a completely folded state.

FIGS. 7 through 12 show another possible embodiment of watercraft beaching device 10 which is similar in most respects to the embodiment shown in FIG. 2 with the exception of the base member being replaced by an elongated pivoting base support member 23. Pivoting base support 23 is pivotally attached to base clearance block 19. When device 10 is setup, as is shown in FIG. 7, pivoting base support 23 is rotated 90° with respect to base clearance block 19. Device 10 is collapsed by folding both sets of legs 15 and 16 together, rotating pivoting base support 23 back so it is parallel with base clearance block 19 and inverting the entire assembly, as is shown in FIGS. 8 through 12. Advantageously, handles 22 are attached to the distal edges of free legs 16 to aid in transporting device 10 in this inverted position as well as aiding the device to remain in the collapsed configuration during transport.

FIGS. 13 through 17 show another possible embodiment of watercraft beaching device 10 which is essentially two foreshortened versions of the embodiment shown in FIG. 2 hinged together along a central transverse line. Watercraft beaching device 10 includes a pair of base members 14 hinged together, via base hinge 24, to which collapsible upright supports 11 and 12 are hinged via four base hinges 18. Each of the upright supports here includes a pair of hinge legs 15 and a pair of free legs 16 each hinged to one hinge leg 15 via leg hinges 17. Base hinges 18 are attached to bases 14 by base clearance blocks 19. Advantageously, handles 22 are attached at opposing central points along the hinge line of base clearance blocks 19. This placement of handles 22 aids in folding and transporting of device 10.

Figure 13:
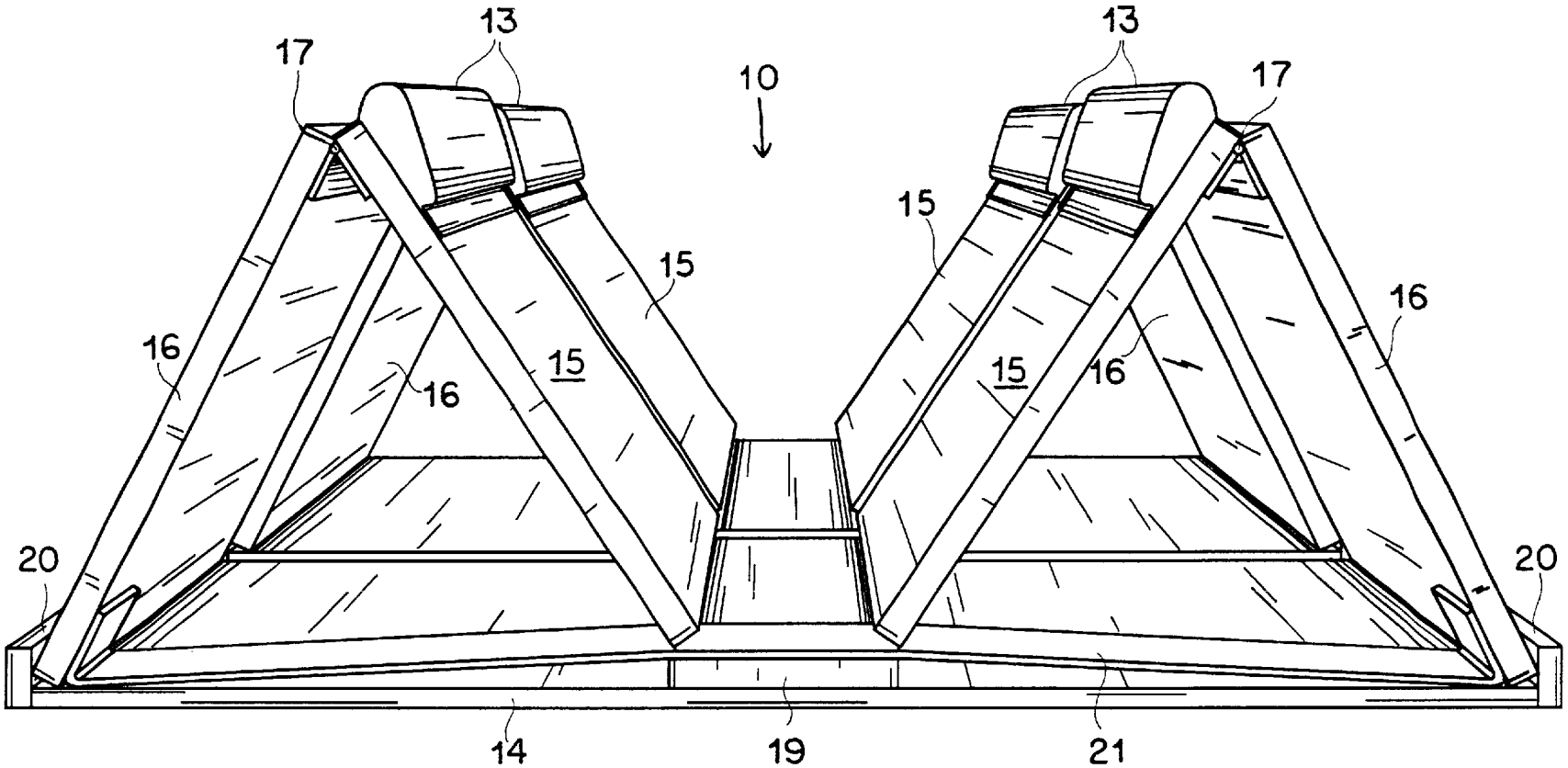
FIG. 13 is a front perspective view of yet another possible embodiment of the invention.
Figure 14:
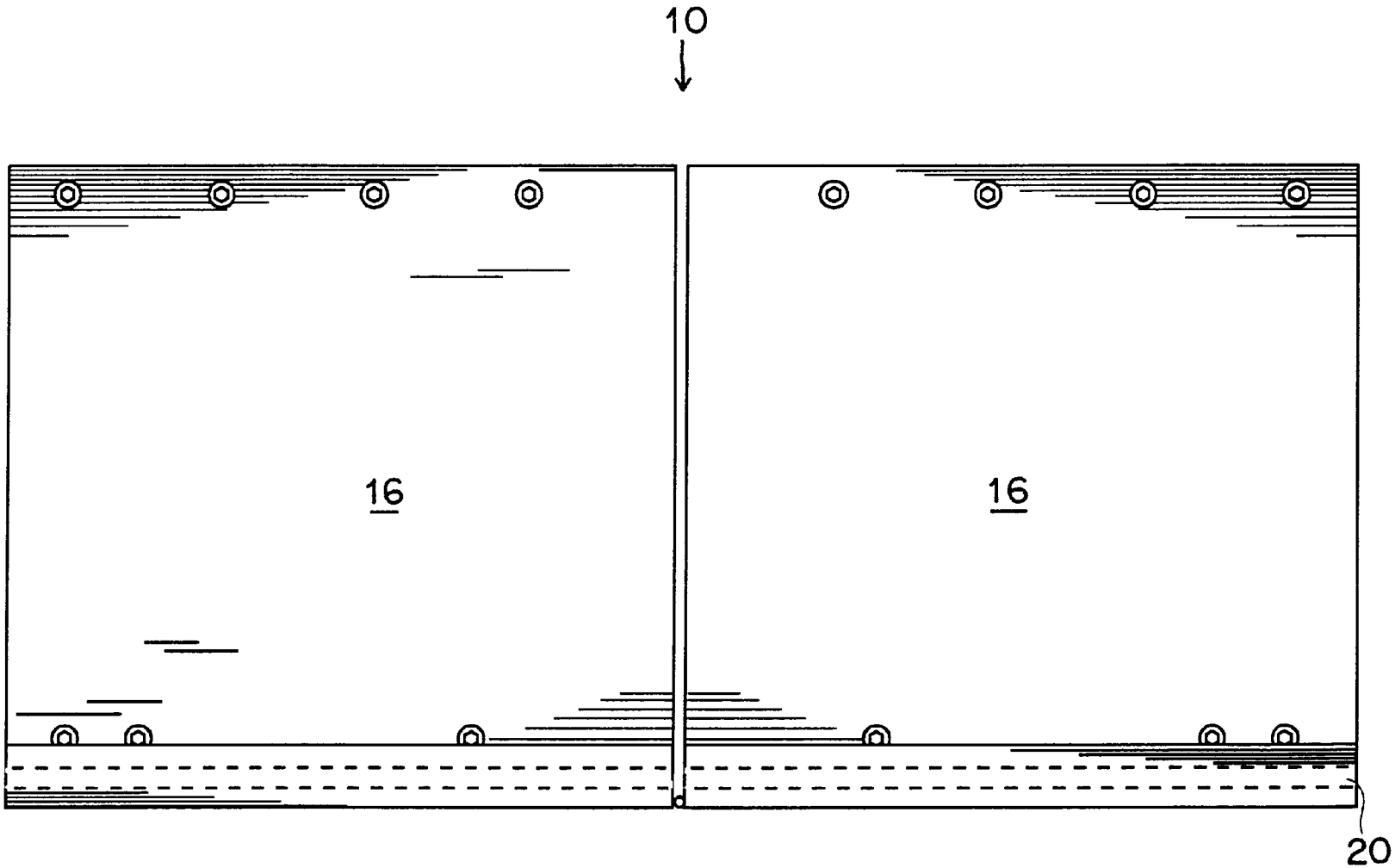
FIG. 14 is a side view of the embodiment of FIG. 13.
Figure 15:
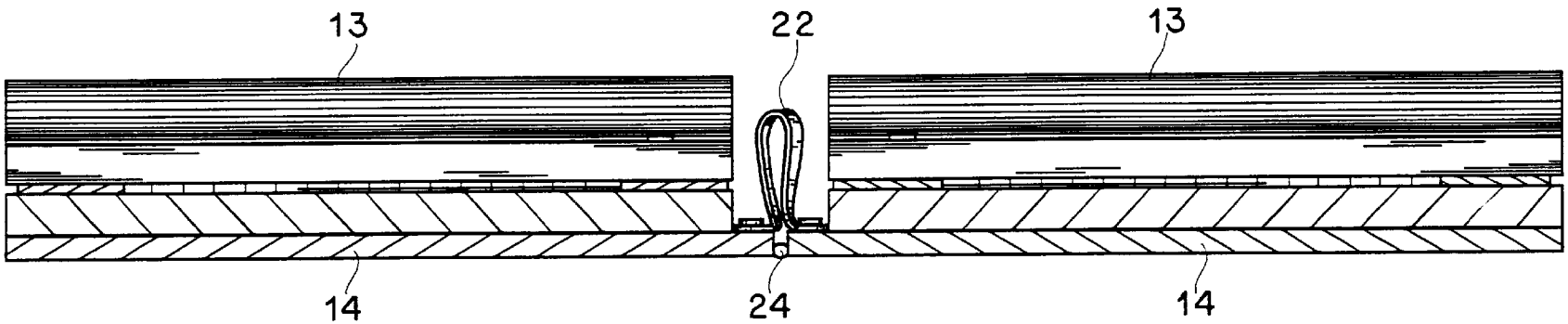
FIG. 15 is a side sectional view of the embodiment of FIG. 13.
Figure 16:
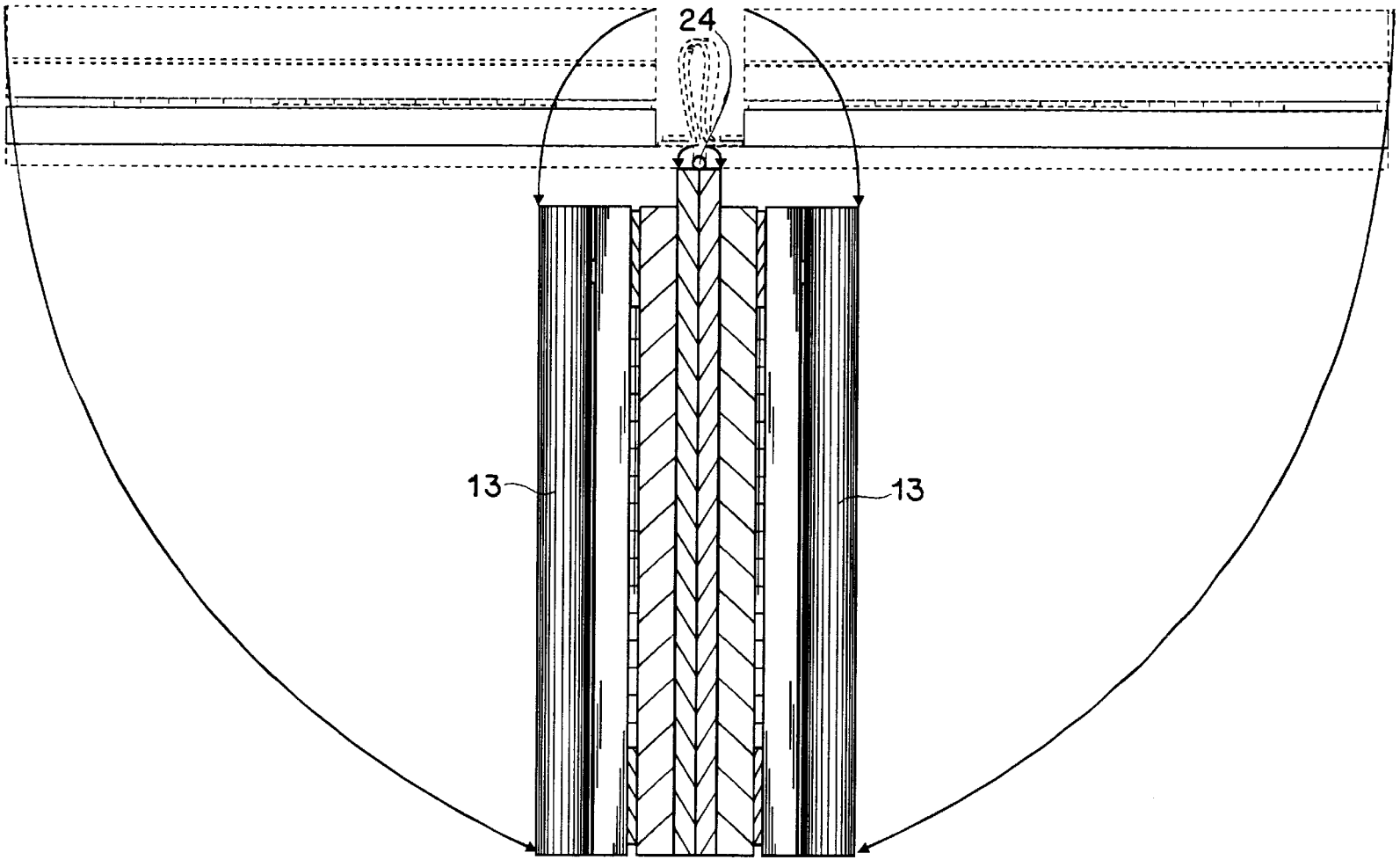
FIG. 16 is a side sectional view of the embodiment of FIG. 13.
Figure 17:
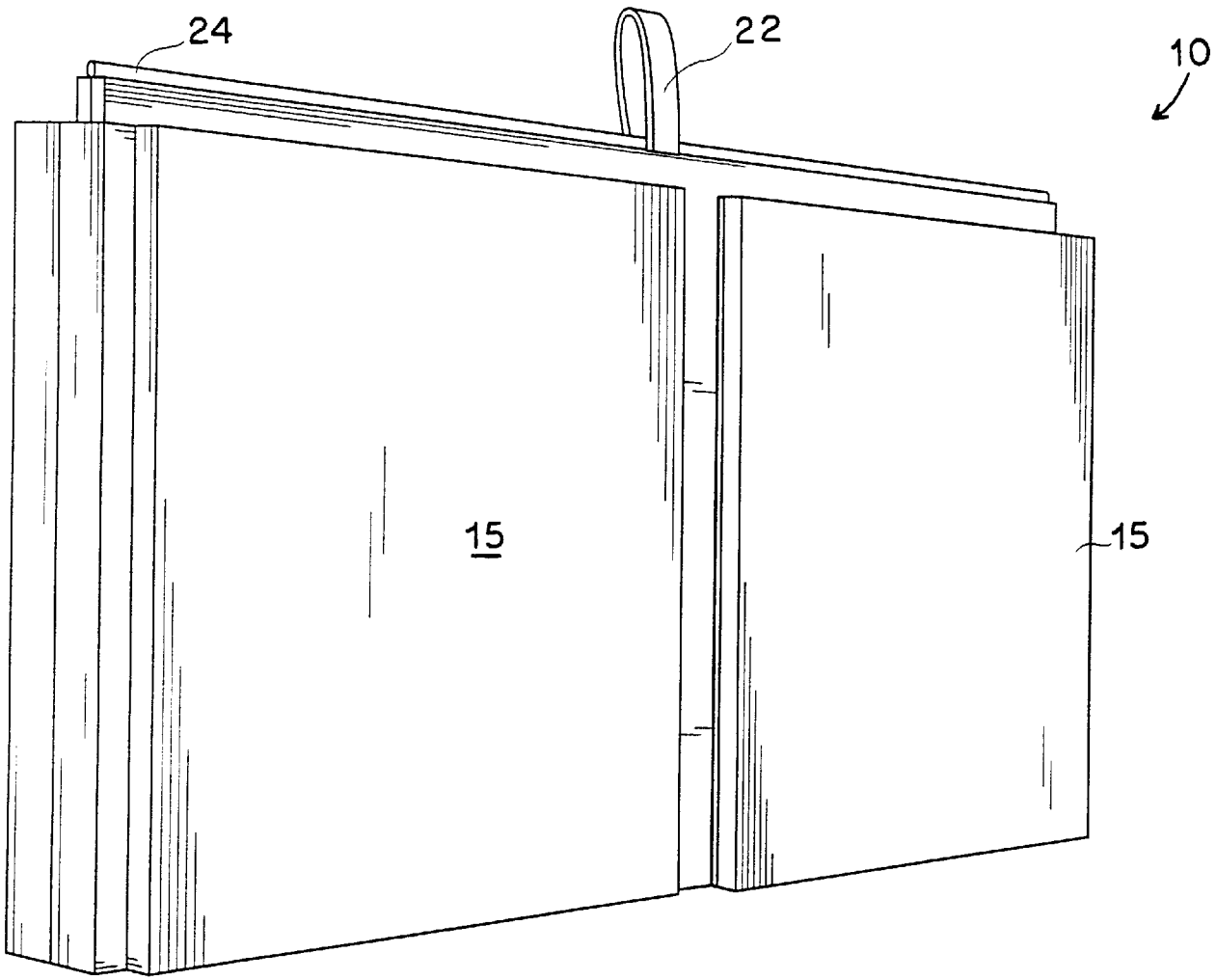
FIG. 17 is a front perspective of the embodiment of FIG. 13 in a completely folded state.

FIG. 13 shows watercraft beaching device 10 in it's fully setup position. To collapse the device, the distal edges of free legs 16 are folded inward about hinges 17 and at the same time, hinge legs 15 are pivoted about hinges 18 toward a more vertical position. The folded support assemblies are then folded down, about hinges 18 into the position shown in FIG. 15. Handles 22 are then grasped and lifted which allows base members 14 to fold together about hinge 24 forming the compact assembly shown in FIGS. 16 and 17.

Figure 18:
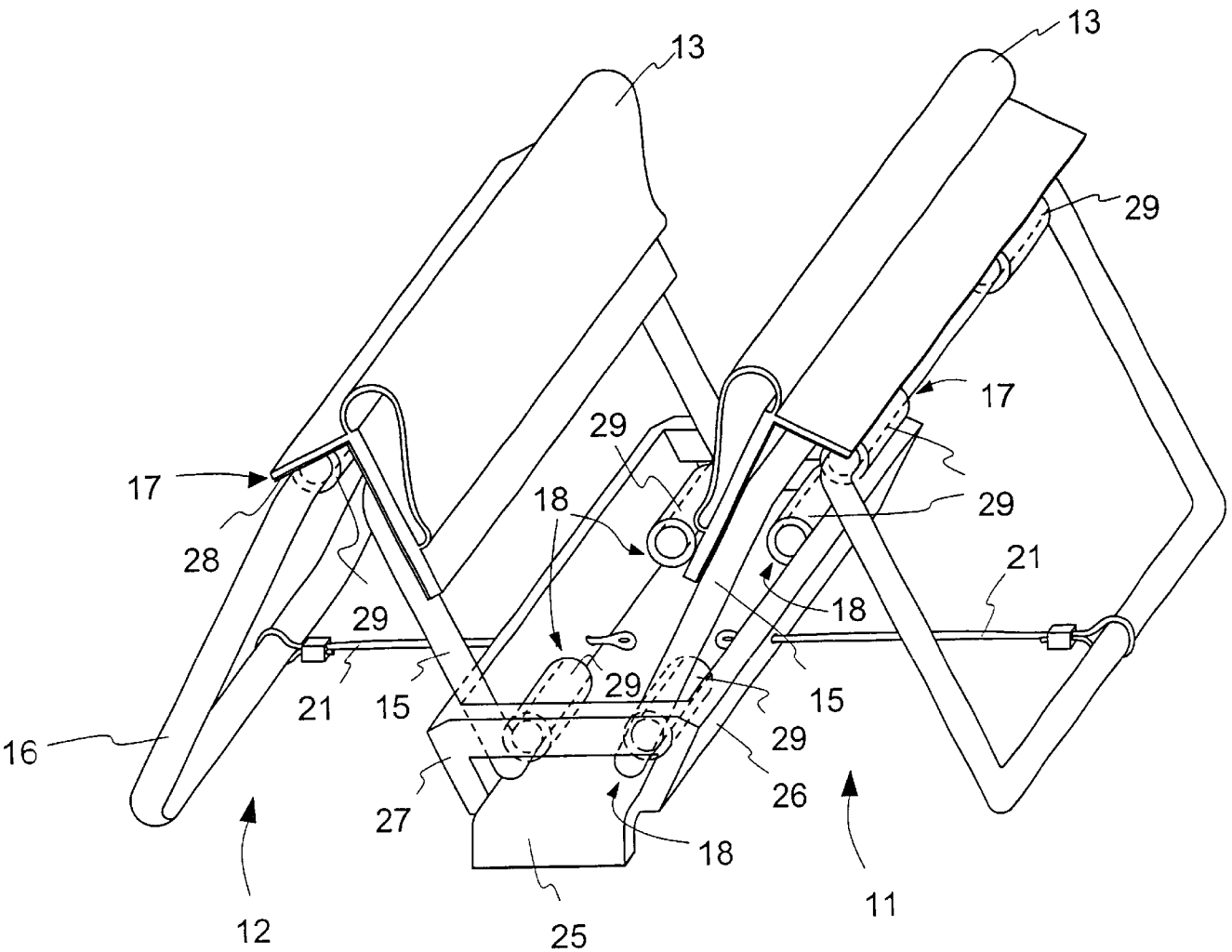
FIG. 18 is a front perspective view of yet another possible embodiment of the invention.
Figure 19:
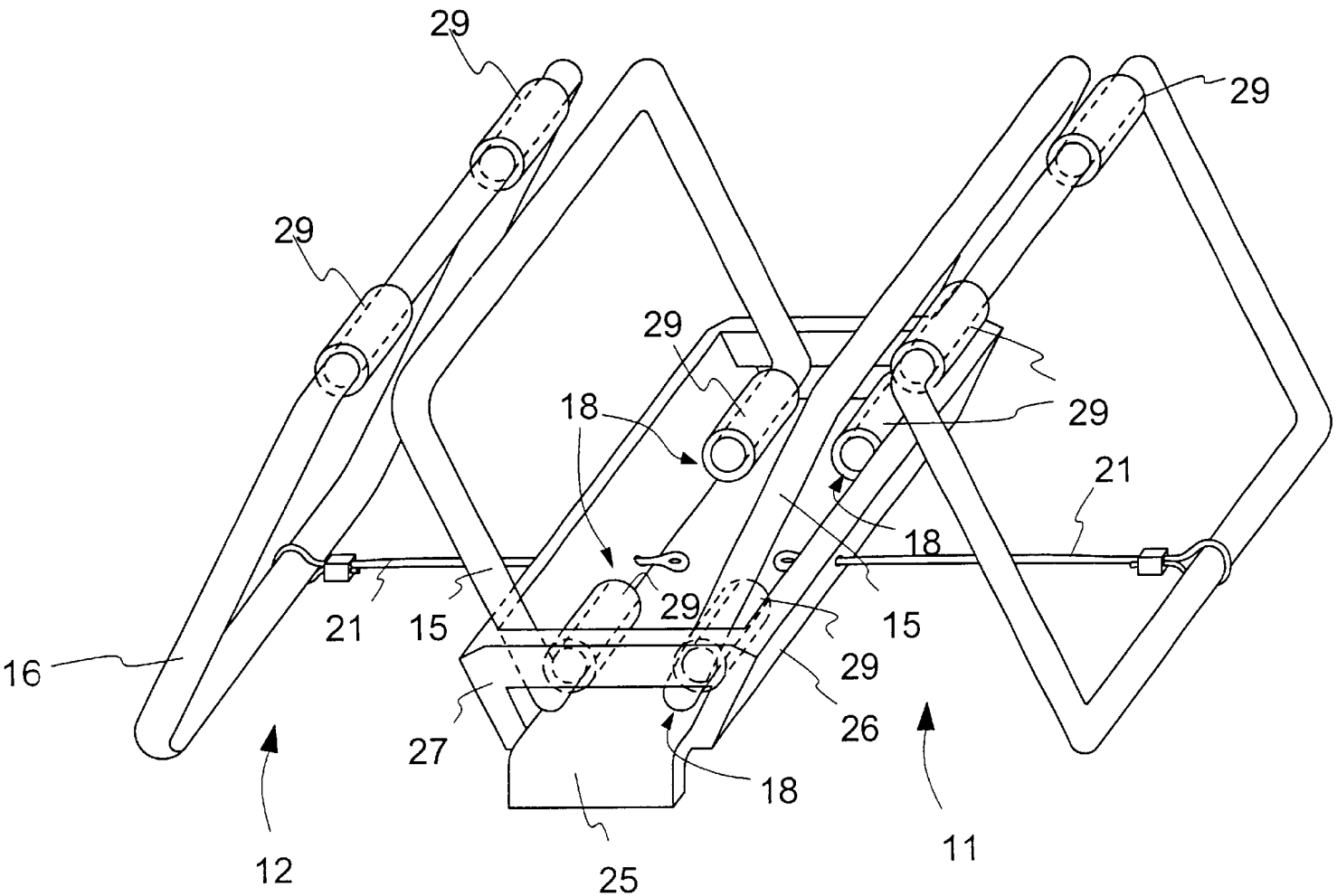
FIG. 19 is a front perspective view of the embodiment shown in FIG. 18 with the hull engagement surfaces removed for the sake of illustration and clarity.

FIGS. 18 through 19 illustrate another possible embodiment which includes a base 14 to which collapsible upright supports 11 and 12 are hinged via base hinges 18. Each of the upright supports here includes a hinge leg 15 and a free leg 16 which are hinged together via leg hinge 17. Hinge leg 15 is attached to base 14 by base hinge 18, which is here a cylindrical tube fixed to base 14 to rotatably receive the ends of hinge leg 15. Base 14 is advantageously an elongated trough formation of steel, which may include ground engaging tangs 25 to help prevent the base from moving with respect to the ground in use. Trough walls 26 and 27 limit the extension of hinge legs 15 and prevent base 14 from raising, which can cause the center of the device to contact the hull and can increase the separation distance between hull engagement cushions 13. The angle of trough walls 26 and 27 can be varied to accommodate various shape watercraft hulls. It should be noted that other structures can serve the same purposes as trough walls as is evidenced in the forgoing embodiments. Rather than walls, smaller ear or tang projections or rotational stops can be used. Additionally, it may be possible to use extension limiting straps between hinge legs 15 instead of the trough walls or similar structure.

Extension limiting straps or cables 21 may also be used to limit the extension of free legs 16. Here, extension limiting cables 21 are connected between the distal edge of free legs 16 and centrally located points on base 14. Here a fixed loop encircles each of the mid-sections of the distal portion of free legs 16 and has a connected end attached to base 14 via a nut and bolt, rivet, spot-weld or similar attachment.

Leg hinges 17 are here composed of a hull support cushion base plate 28 and cylindrical tube 29 fixed thereto. Hull support cushion base plates 28 are here generally "L" shaped in cross-section and rigidly affixed to the distal ends of hinge legs 15. The proximal ends or portions of free legs 16 are rotatably secured within tubes 29 to complete the hinge.

Figure 20:
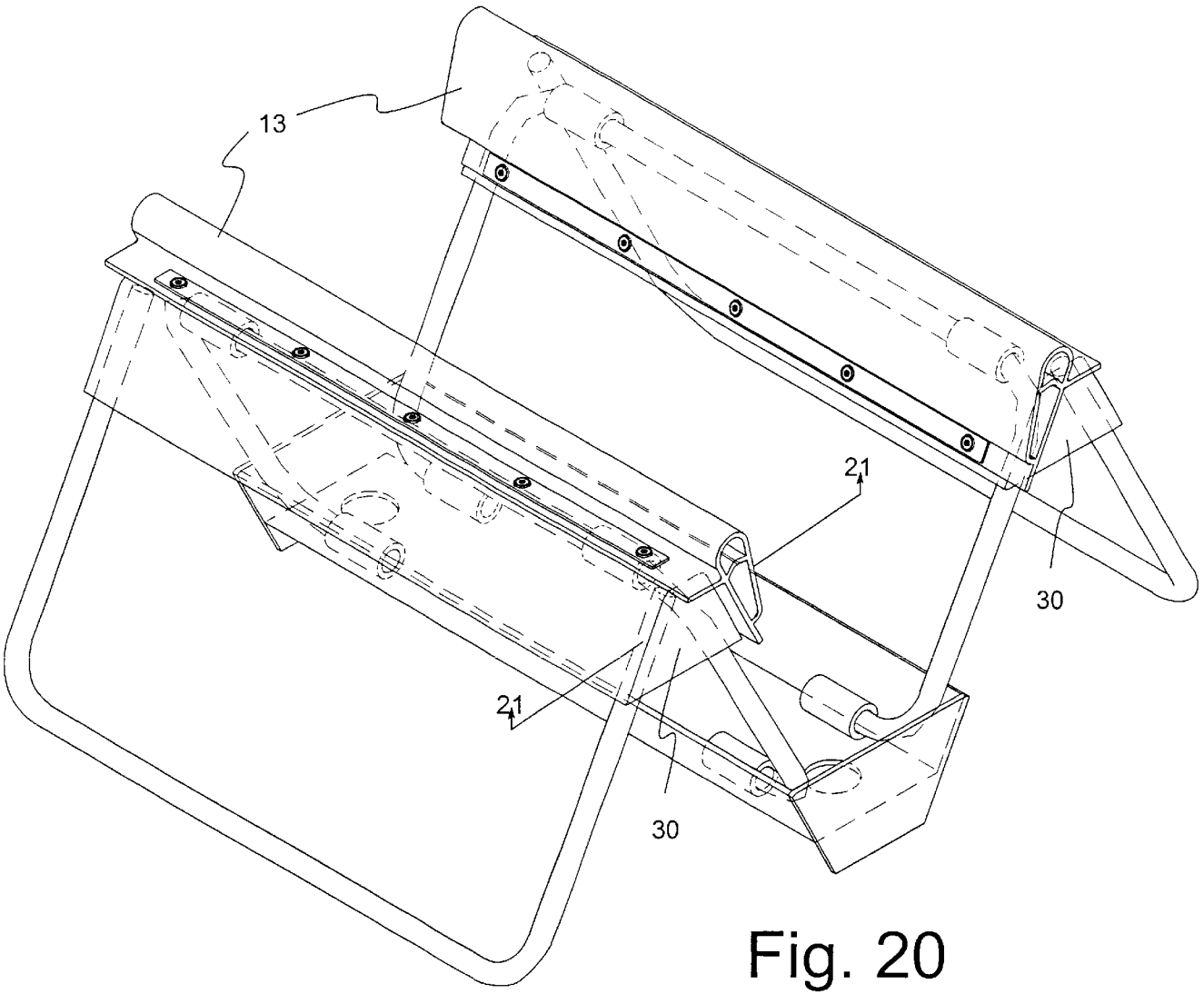
FIG. 20 is an isometric view of another possible embodiment of the invention.
Figure 21A:
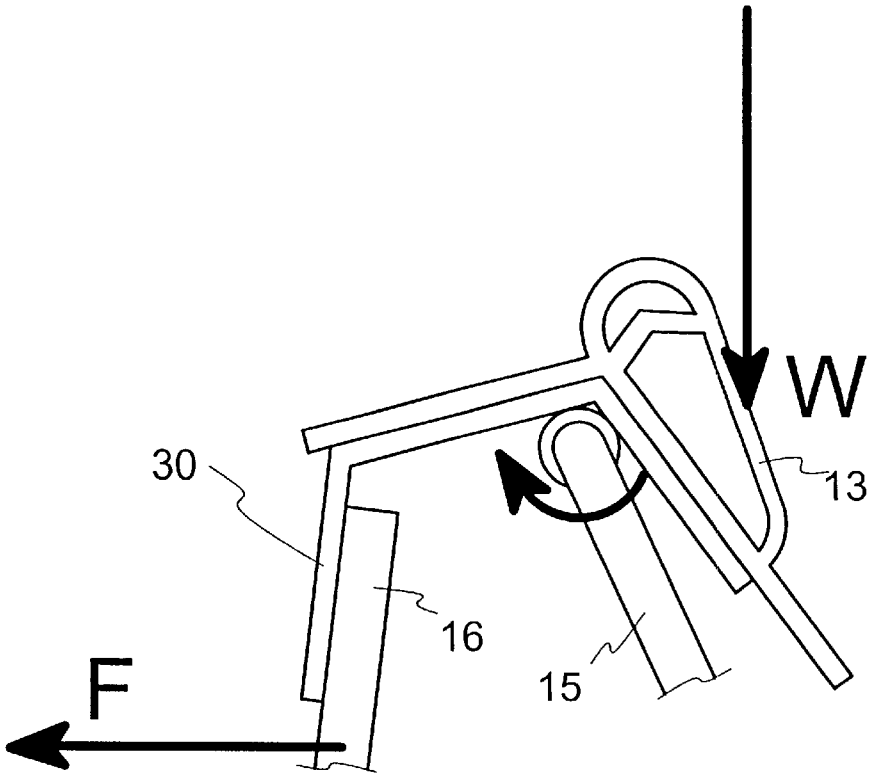
FIG. 21A is a detail cross-section taken along section line 21—21 of FIG. 20.
Figure 21B:
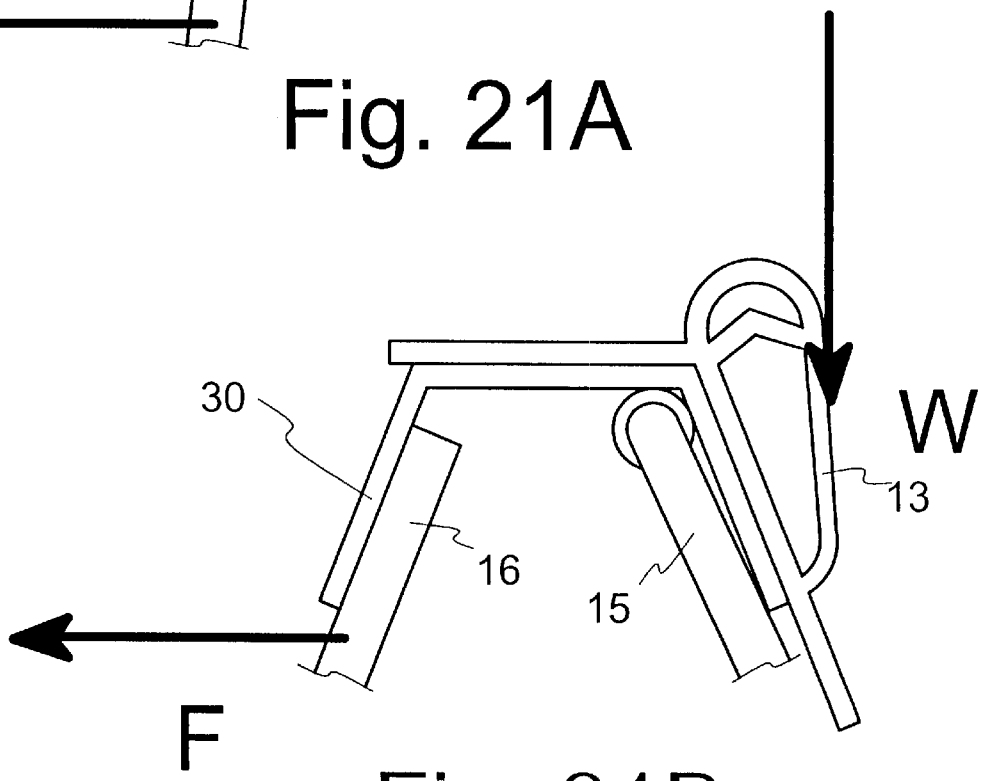
FIG. 21B is a detail cross-section taken along section line 21—21 of FIG. 20.

In yet another embodiment of the invention illustrated in FIGS. 20, 21A and 21B, the free leg extension limiting feature is provided by generally "V" shaped top caps 30. Top caps 30 are similar in construction to the steel trough construction explained above. Here, however, the proximal ends of free legs 16 are fixed to the respective distal walls of top caps 30 while the distal ends of hinge legs 15 are pivotally attached to respective proximal walls of top caps 30. Hence, the sub-assemblies of the free legs and top caps each rotate about the distal ends of hinge legs 15. The weight of a boat on cushions 13 creates a moment of force about the axis of the distal ends of legs 15 which consequently forces the distal ends of free legs 16 away from base 14. The proximal walls of top caps 30 interact with the sides of hinge legs 15 to provide the extension limiting function for free legs 16.

Many modifications and alterations are possible. For example, while the device has been illustrated as being constructed out of a solid planar material, it could be a frame construction made of tubing or the like. It could be made of molded plastic in both solid or webbed forms. One specific addition includes adding a lid to the assembly shown in FIGS. 1 through 6. The lid may be a rigid planar member and may include a cushioned mat to make entering and exiting the watercraft more comfortable. The cushioned mat can be employed without the lid. Additionally, locking mechanisms can be added to interact between various portions of the devices to lock the device into open and closed positions.

While there is shown and described certain embodiments of the invention, it is to be distinctly understood that this invention is not limited thereto but may be variously embodied to practice within the scope of the following claims.

We claim:

1. A watercraft beaching device which comprises:

a base member having a low profile to prevent contact with the watercraft;

a pair of collapsible upright supports each pivotally attached to the base member;

a first extension limiting device interacting between the base and the upright supports;

a second extension limiting device interacting with each of the upright support to limit their expansion to a predefined range; and a pair hull engagement surfaces positionable in spaced apart relationship one to the other and at an elevation above the base member, the hull engagement surfaces each being attached to one of the upright supports.

2. The watercraft beaching device of claim 1 wherein the collapsible supports each comprise:

a hinge leg pivotally attached to the base member; and a free leg pivotally attached to the hinge leg.

3. The watercraft beaching device of claim 2 wherein the first extension limiting device is attached between the base member and each hinge leg.

4. The watercraft beaching device of claim 3 wherein the second extension limiting member is attached between each hinge leg and its respective free leg.

* * * * *